US010370867B2

(12) United States Patent
Rosato

(10) Patent No.: US 10,370,867 B2
(45) Date of Patent: Aug. 6, 2019

(54) FENCE EXTENSION SYSTEM

(71) Applicant: Frances Rosato, Lindenhurst, NY (US)

(72) Inventor: Frances Rosato, Lindenhurst, NY (US)

( * ) Notice: Subject to any disclaimer, the term of this patent is extended or adjusted under 35 U.S.C. 154(b) by 386 days.

(21) Appl. No.: 15/285,704

(22) Filed: Oct. 5, 2016

(65) Prior Publication Data

US 2018/0094453 A1 Apr. 5, 2018

(51) Int. Cl.
*E04H 17/24* (2006.01)

(52) U.S. Cl.
CPC ..... *E04H 17/24* (2013.01)

(58) Field of Classification Search
CPC ..... E04H 17/003; E04H 17/16; E04H 17/165; E04H 17/166; E04H 17/14; E04H 17/1408; E04H 17/18
See application file for complete search history.

(56) References Cited

U.S. PATENT DOCUMENTS 4,193,583 A 3/1980 Witt
4,685,656 A * 8/1987 Lee ..... E04H 17/161 256/13.1
4,872,647 A 10/1989 Paradise et al.
5,143,354 A 9/1992 Nolan
D370,268 S 5/1996 Houry
5,577,710 A 11/1996 Kirby
5,878,802 A * 3/1999 Richter ..... A47G 5/00 160/135
8,387,955 B2 * 3/2013 Ptacek ..... E04H 17/163 256/24
9,441,384 B2 * 9/2016 Rosati ..... E04H 17/163
2001/0052595 A1 12/2001 Hulett
2005/0173690 A1 * 8/2005 Penning ..... E04H 17/18 256/65.14
2008/0230758 A1 * 9/2008 Reinert ..... E04H 17/16 256/1
2014/0332742 A1 * 11/2014 Gentles ..... A63B 71/022 256/25

FOREIGN PATENT DOCUMENTS

FR 1 501 586 * 11/1967 ..... E04H 17/16
JP 8-294348 * 11/1996 ..... E04H 17/04
JP 2589639 * 3/1997 ..... E04H 17/16

* cited by examiner

*Primary Examiner* — Michael P Ferguson

(57) ABSTRACT

A fence extension system for selectively increasing a height of a fence includes a fence that has a plurality of sections. A plurality of screen units is provided. Each of the screen units is removably coupled to an associated one of the sections. Each of the screen units extends upwardly from the associated section. Thus, each of the screen units enhances privacy of the fence.

7 Claims, 5 Drawing Sheets

FENCE EXTENSION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to extension devices and more particularly pertains to a new extension device for selectively increasing a height of a fence.

BRIEF SUMMARY OF THE INVENTION

An embodiment of the disclosure meets the needs presented above by generally comprising a fence that has a plurality of sections. A plurality of screen units is provided. Each of the screen units is removably coupled to an associated one of the sections. Each of the screen units extends upwardly from the associated section. Thus, each of the screen units enhances privacy of the fence.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
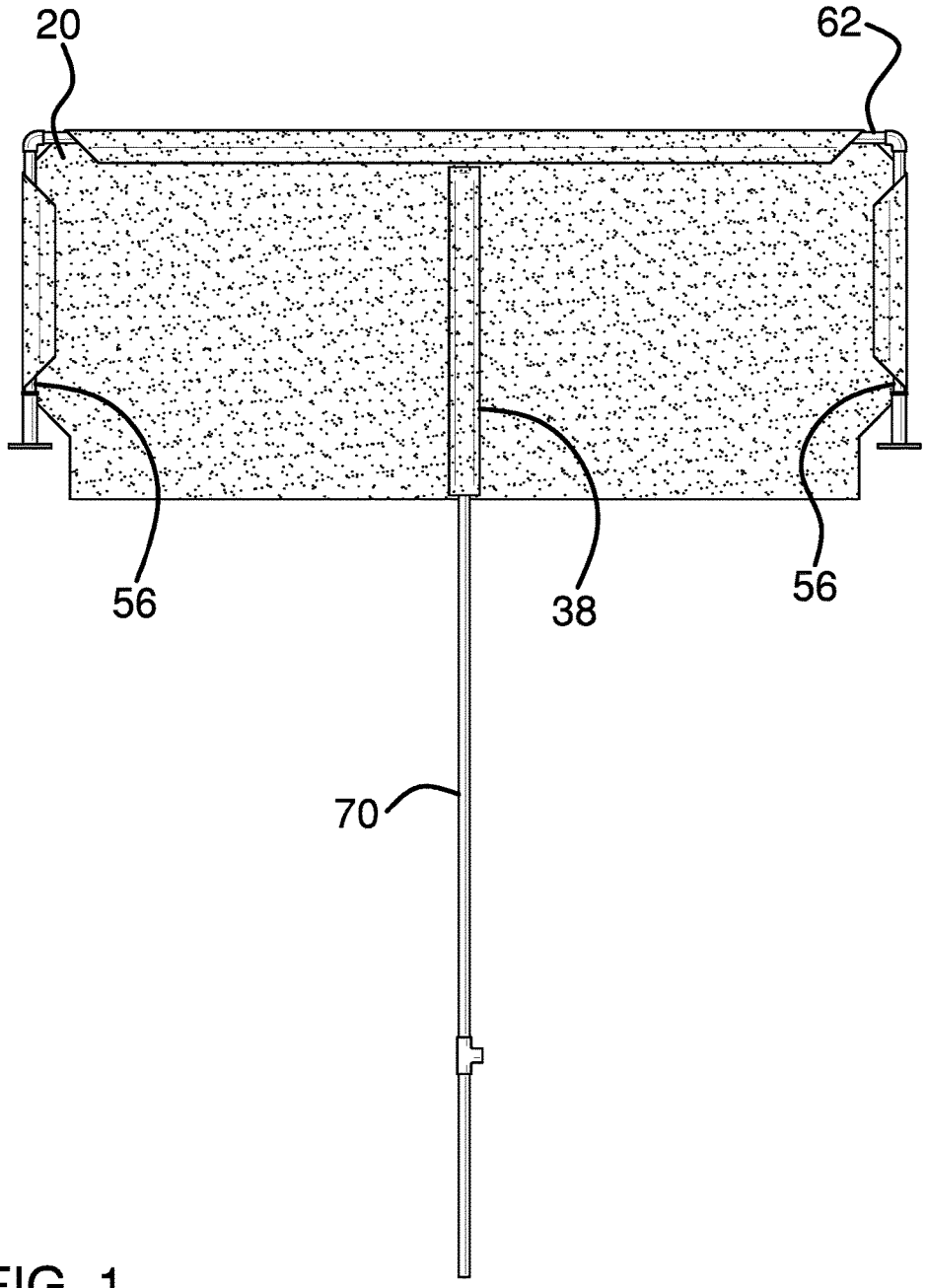
FIG. 1 is a perspective view of a screen unit of fence extension system according to an embodiment of the disclosure.
Figure 2:
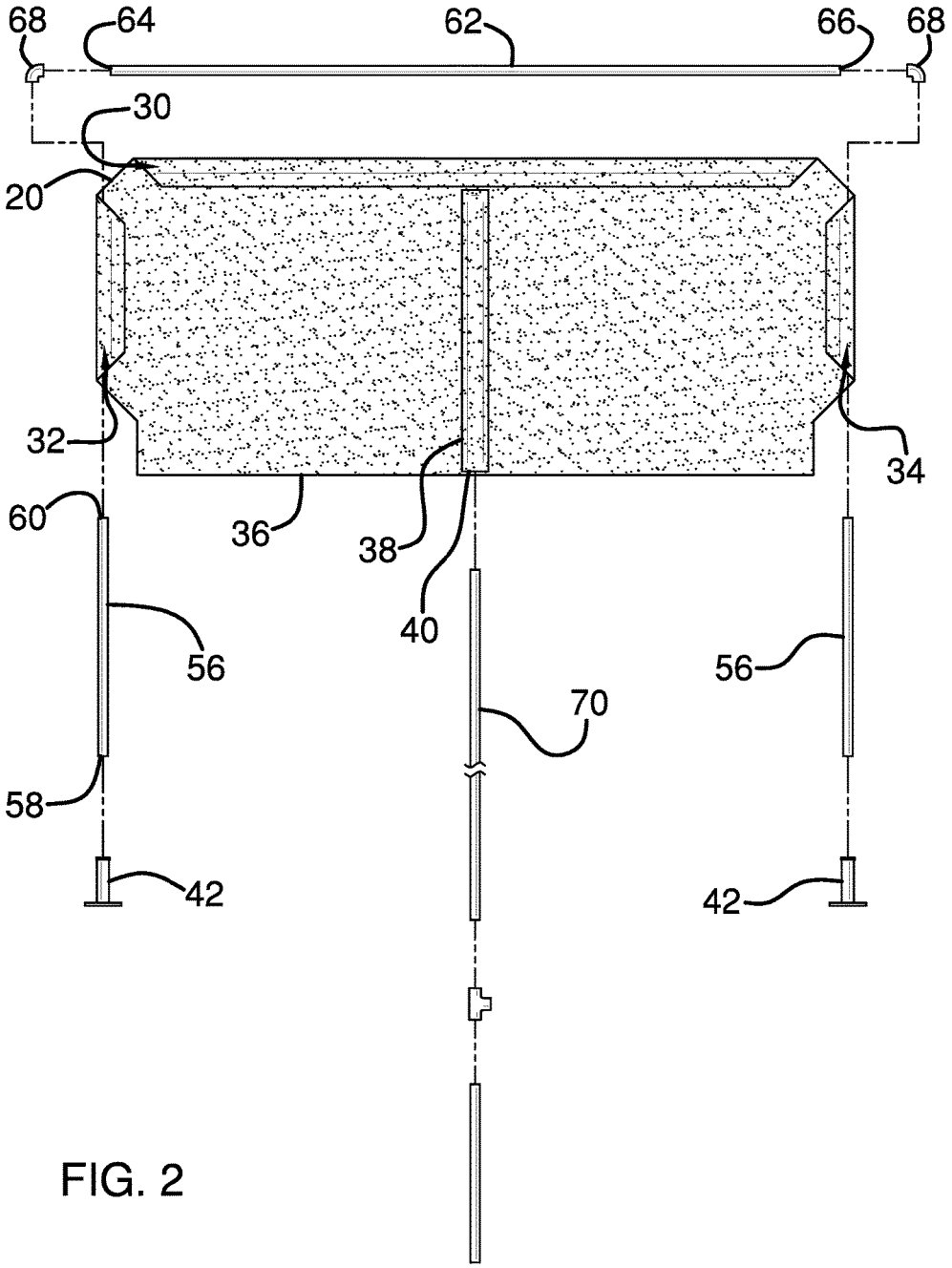
FIG. 2 is an exploded perspective view of a screen unit of an embodiment of the disclosure.
Figure 3:
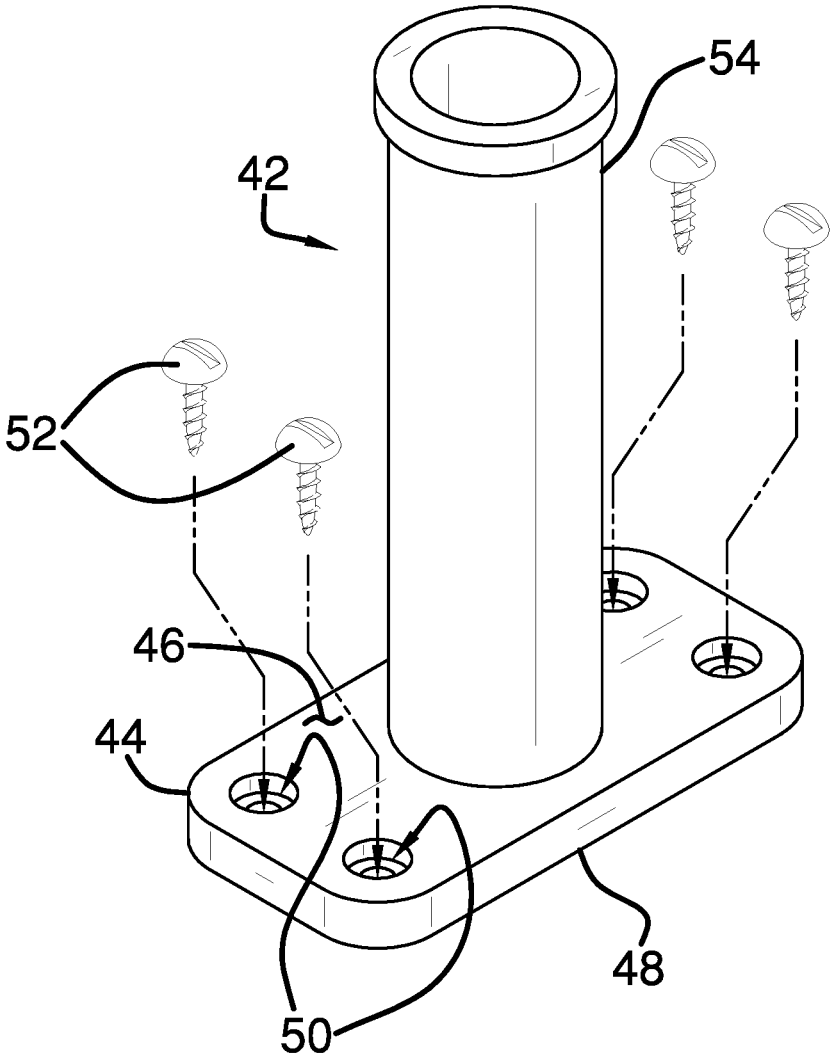
FIG. 3 is a perspective view of a receiver of an embodiment of the disclosure.
Figure 4:
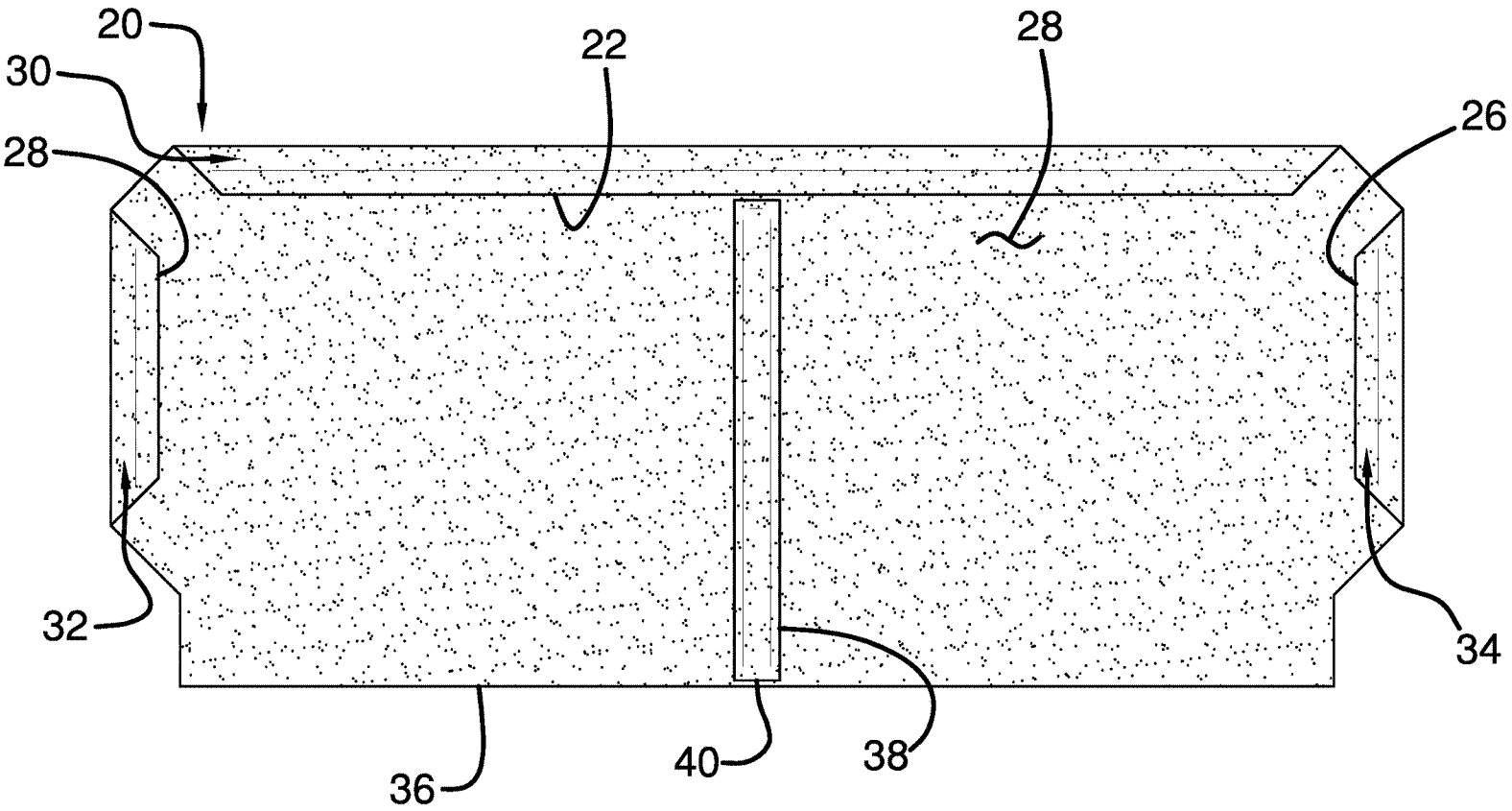
FIG. 4 is a back view of panel of an embodiment of the disclosure.
Figure 5:
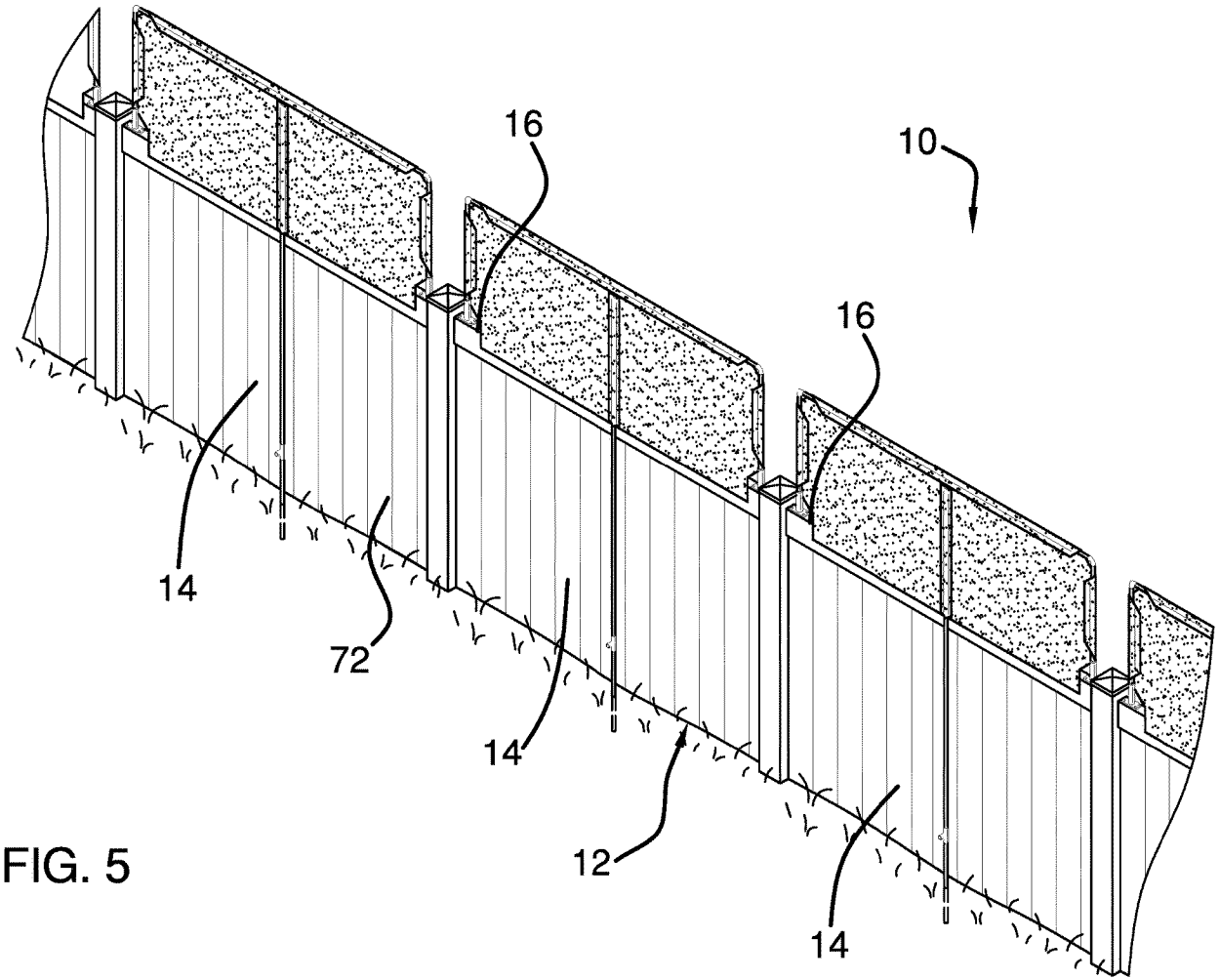
FIG. 5 is a perspective in-use view of an embodiment of the disclosure.

With reference now to the drawings, and in particular to FIGS. 1 through 5 thereof, a new extension device embodying the principles and concepts of an embodiment of the disclosure and generally designated by the reference numeral 10 will be described.

As best illustrated in FIGS. 1 through 5, the fence extension system 10 generally comprises a fence 12. The fence 12 has a plurality of sections 14. Each of the sections 14 has a top edge 16. The fence 12 may surround a yard or the like.

A plurality of screen units 18 is provided. Each of the screen units 18 is removably coupled to an associated one of the sections 14. Each of the screen units 18 extends upwardly from the associated section 14. Thus, each of the screen units 18 enhances privacy of the fence 12.

Each of the screen units 18 comprises a panel 20 that has a top edge 22, a first lateral edge 24, a second lateral edge 26 and a first surface 28. The top edge 22 is coupled to the first surface 28 to define a top channel 30. The first lateral edge 24 is coupled to the first surface 28 to define a first lateral channel 32. The second lateral edge 26 is coupled to the first surface 28 to define a second lateral channel 34. Moreover, the top channel 30 is spaced from the first lateral channel 32 and the second lateral channel 34.

An intersection between each of the first lateral edge 24, the second lateral edge 26 and the top edge 16 may be dog eared. The panel 20 has a bottom edge 36. Each of the first lateral channel 32 and the second lateral channel 34 are spaced from the bottom edge 36. The panel 20 is comprised of a deformable and translucent material.

A tube 38 is provided and the tube 38 coupled to the first surface 28 of the panel 20. The tube 38 has a bottom end 40 and the bottom end 40 is open. The tube 38 is substantially hollow and the tube 38 is vertically oriented on the panel 20. Moreover, the tube 38 is centrally positioned on the panel 20.

A pair of receivers 42 is provided. Each of the receivers 42 is coupled to the top edge 16 of the associated section. The receivers 42 are spaced apart from each other. Each of the receivers 42 comprises a plate 44 that has a first surface 46 and a second surface 48. The plate 44 has a plurality of openings 50 extending through the first surface 28 and the second surface 48.

The second surface 48 is positioned to abut the top edge 16 of the associated section 14. A plurality of fasteners 52 is provided. Each of the fasteners 52 extends through an associated one of the openings 50 and engages the fence 12. The plurality of fasteners 52 may comprise a screw or the like. A cup 54 is coupled to and extends upwardly from the first surface 46 of the plate 44.

A pair of end poles 56 is provided. Each of the end poles 56 has a first end 58 and a second end 60. Each of the end poles 56 is slidably inserted into an associated one of the first lateral channel 32 and the second lateral channel 34. The first end 58 corresponding to each of the end poles 56 is inserted into the cup 54 corresponding to an associated one of the receivers 42. Thus, the panel 20 is positioned to extend upwardly from the fence 12.

A top pole 62 is provided that has a primary end 64 and a secondary end 66. The top pole 62 is slidably inserted into the top channel 30. A pair of elbows 68 is provided. Each of the elbows 68 is positioned on an associated one of the primary end 64 and the secondary end 66. Moreover, each of the elbows 68 insertably receives the second end 60 corresponding to an associated one of the end poles 56. Thus, the top channel 30 is retained in a horizontal orientation.

A center pole 70 is slidably inserted into the tube 38. The center pole 70 has a bottom end 40. The bottom end 40 abuts ground when the center pole 70 is positioned in the tube 38. Thus, the panel 20 is retained in an upright position on the fence 12. The fence 12 has a back side 72 and the center pole 70 is spaced from the back side 72. Moreover, the first surface 28 of the panel 20 is oriented co-planar with the back side 72 of the fence 12. The bottom edge 36 of the panel 20 extends downwardly beyond the top edge 16 of the fence 12.

In use, the pair of receivers 42 corresponding to each of the screen units 18 is coupled to the top side of an associated one of the sections 14. The top pole 62 is inserted into the top channel 30 and each of the elbows 68 is coupled to the top pole 62. Each of the end poles 56 is inserted into an associated one the first lateral channel 32 and the second lateral channel 34. Moreover, each of the end poles 56 is coupled to an associated one of the elbows 68.

Each of the second poles is positioned in the cup 54 of an associated one of the receivers 42. Thus, each of the screen units 18 adds height to the fence 12 thereby enhancing privacy. The center pole 70 is inserted into the tube 38 to stabilize the panel 20. Each of the screen units 18 is selectively removed from the fence 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fence extension system comprising:

a fence having a plurality of sections, each of said sections having a top edge; and a pair of receivers, each of said receivers being coupled to said top edge of said associated section, said receivers being spaced apart from each other, each of said receivers comprising:

a plate having a first surface and a second surface, said plate having a plurality of openings, each of said openings extending through said first surface and said second surface, said second surface being positioned to abut said top edge of said associated section, and a cup being coupled to and extending upwardly from said first surface; and a plurality of screen units, each of said screen units being removably coupled to an associated one of said sections, each of said screen units extending upwardly from said associated section wherein each of said screen units is configured to enhance privacy of said fence, each of said screen units comprising:

a panel having a top edge, a first lateral edge, a second lateral edge, a first surface, a first lateral channel and a second lateral channel; and a pair of end poles, each of said end poles having a first end and a second end, each of said end poles being slidably inserted into an associated one of said first lateral channel and said second lateral channel, said first end corresponding to each of said end poles being inserted into said cup corresponding to an associated one of said receivers having said panel extending upwardly from said fence.

2. The system according to claim 1, wherein each of said screen units comprises said top edge being coupled to said first surface to define a top channel, said first lateral edge being coupled to said first surface to define said first lateral channel, said second lateral edge being coupled to said first surface to define said second lateral channel, said top channel being spaced from said first lateral channel and said second lateral channel.

3. The system according to claim 2, wherein each of said screen units comprises a tube being coupled to said first surface, said tube having a bottom end, said bottom end being open, said tube being substantially hollow, said tube being vertically oriented on said panel, said tube being centrally positioned on said panel.

4. The system according to claim 3, wherein each of said screen units comprises a center pole being slidably inserted into said tube, said center pole having a bottom end, said bottom end being configured to abut ground when said center pole is positioned in said tube thereby facilitating said panel to be retained in an upright position on said fence.

5. The system according to claim 1, wherein each of said screen units comprises:

said panel having a top channel; and a top pole having a primary end and a secondary end, said top pole being slidably inserted into said top channel.

6. The system according to claim 5, wherein each of said screen units comprises a pair of elbows, each of said elbows being positioned on an associated one of said primary end and said secondary end of said top pole, each of said elbows insertably receiving said second end corresponding to an associated one of said end poles such that said top channel is retained in a horizontal orientation.

7. A fence extension system comprising:

a fence having a plurality of sections, each of said sections having a top edge; and a plurality of screen units, each of said screen units being removably coupled to an associated one of said sections, each of said screen units extending upwardly from said associate section wherein each of said screen units is configured to enhance privacy of said fence, each of said screen units comprising:

a panel having a top edge, a first lateral edge, a second lateral edge and a first surface, said top edge being coupled to said first surface to define a top channel, said first lateral edge being coupled to said first surface to define a first lateral channel, said second lateral edge being coupled to said first surface to define a second lateral channel, said top channel being spaced from said first lateral channel and said second lateral channel, a tube being coupled to said first surface, said tube having a bottom end, said bottom end being open, said tube being substantially hollow, said tube being vertically oriented on said panel, said tube being centrally positioned on said panel, a pair of receivers, each of said receivers being coupled to said top edge of said associated section, said receivers being spaced apart from each other, each of said receivers comprising:

a plate having a first surface and a second surface, said plate having a plurality of openings, each of said openings extending through said first surface and said second surface, said second surface being positioned to abut said top edge of said associated section; and a cup being coupled to and extending upwardly from said first surface;

a pair of end poles, each of said end poles having a first end and a second end, each of said end poles being slidably inserted into an associated one of said first lateral channel and said second lateral channel, said first end corresponding to each of said end poles being inserted into said cup corresponding to an associated one of said receivers having said panel extending upwardly from said fence, a top pole having a primary end and a secondary end, said top pole being slidably inserted into said top channel, a pair of elbows, each of said elbows being positioned on an associated one of said primary end and said secondary end, each of said elbows insertably receiving said second end corresponding to an associated one of said end poles such that said top channel is retained in a horizontal orientation, and a center pole being slidably inserted into said tube, said center pole having a bottom end, said bottom end being configured to abut ground when said center pole is positioned in said tube thereby facilitating said panel to be retained in an upright position on said fence.

* * * * *